United States Patent [19]

Mercatoris

[11] Patent Number: 4,533,124

[45] Date of Patent: Aug. 6, 1985

[54] DEVICE FOR DELIVERING GASEOUS AND SOLID MATERIALS TO A METAL POOL DURING A REFINING PROCESS

[75] Inventor: Robert Mercatoris, Eich, Luxembourg

[73] Assignee: MecanARBED-Dommeldange S.a.r.l., Luxembourg

[21] Appl. No.: 542,429

[22] Filed: Oct. 17, 1983

[30] Foreign Application Priority Data

Oct. 22, 1982 [LU] Luxembourg ..... 84433

[51] Int. Cl.[3] ..... C21C 5/32

[52] U.S. Cl. ..... 266/225; 266/266; 266/268; 266/270

[58] Field of Search ..... 266/221, 222, 225, 265, 266/266, 267, 268, 270; 75/51; 239/132.3, 548, 558

[56] References Cited

U.S. PATENT DOCUMENTS

| | | | |
|---|---|---|---|
| 2,829,960 | 4/1958 | Vogt | 266/225 |
| 3,020,201 | 8/1965 | Masella et al. | 239/132.3 |
| 3,121,457 | 2/1964 | Whipple et al. | 239/132.3 |
| 3,240,481 | 3/1966 | Smith | 239/132.3 |
| 3,653,877 | 4/1972 | Enya | 266/225 |
| 3,697,058 | 10/1972 | Chaikin et al. | 239/132.3 |
| 3,706,520 | 12/1972 | Grimm et al. | 239/132.3 |
| 3,730,505 | 5/1973 | Ramacciotti et al. | 239/132.3 |
| 3,752,402 | 8/1973 | Marioneaux | 266/225 |
| 4,293,123 | 10/1981 | Sauert | 266/268 |
| 4,301,969 | 11/1981 | Sharp | 266/225 |
| 4,417,721 | 11/1983 | Pehlke et al. | 266/225 |

FOREIGN PATENT DOCUMENTS

| | | | |
|---|---|---|---|
| 0612963 | 6/1978 | U.S.S.R. | 266/222 |
| 0899661 | 1/1982 | U.S.S.R. | 266/266 |

*Primary Examiner*—L. Dewayne Rutledge
*Assistant Examiner*—Robert L. McDowell
*Attorney, Agent, or Firm*—Fishman & Dionne

[57] ABSTRACT

A blowing apparatus for simultaneously delivering gaseous and solid materials to a hot metal melt during refining is presented. The blowing apparatus or blowing lance provides a novel structure of an inner block, an outer block housing, and tubing wherein incompatible materials (i.e., oxygen and carbon) may be safely and simultaneously delivered by use of a protective structure which also functions as a cooling device. The blowing lance further includes a variety of nozzles for blowing materials both above and below the surface of the metal pool.

15 Claims, 3 Drawing Figures

FIG. 1
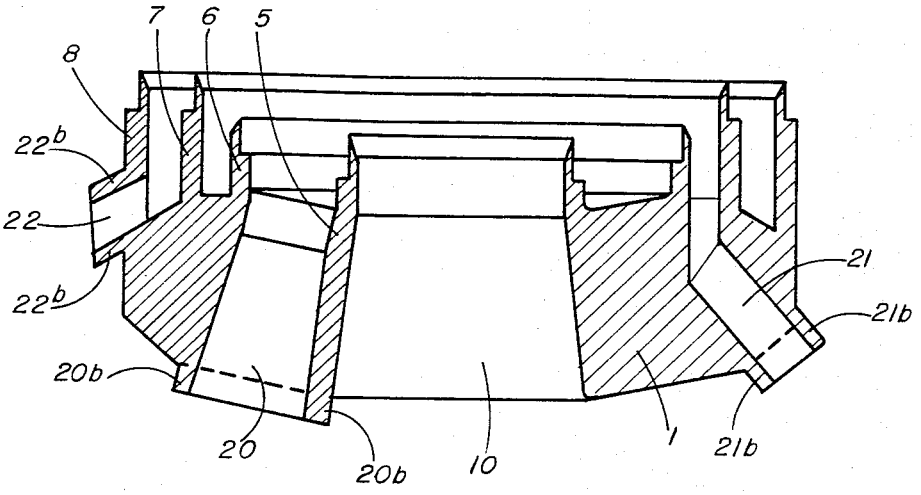
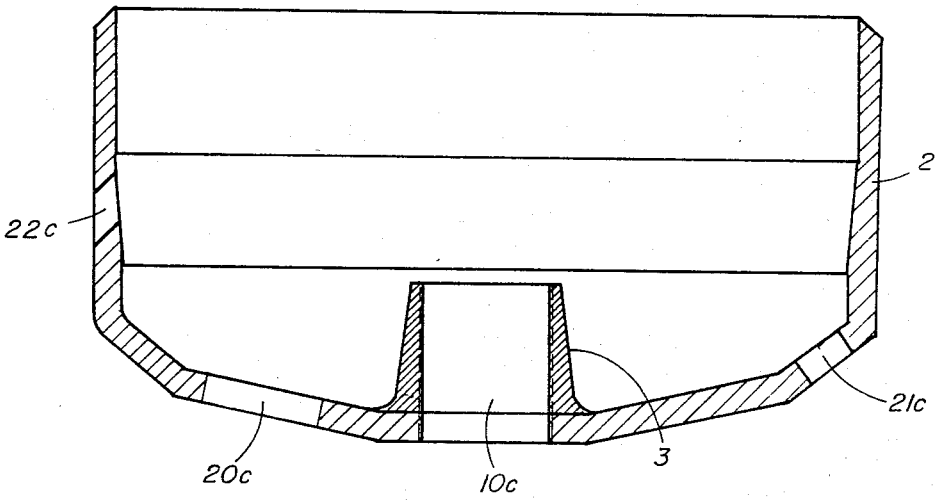
FIG. 2

DEVICE FOR DELIVERING GASEOUS AND SOLID MATERIALS TO A METAL POOL DURING A REFINING PROCESS

BACKGROUND OF THE INVENTION

This invention relates to a blowing apparatus for delivering gaseous and solid materials to a hot melt during a refining process. More particularly, this invention relates to a new and improved blowing lance for safely and simultaneously delivering oxygen and carbonaceous materials to a metal bath both above and below the surface of the melt.

During a typical refining process, oxygen is delivered to the hot melt and is utilized for a variety of functions. The particular function determines the manner of delivery. For example, a quantity of oxygen needed for refining the metal will be delivered below the surface of the pool (by a pressurized stream which penetrates into the bath) to ensure the interaction of the oxygen with the carbon. This reaction will ultimately form carbon monoxide gas. As a result of the carbon monoxide formed therefrom, an additional quantity of oxygen is distributed above the surface of the metal pool for the purpose of burning or combusting the newly formed carbon monoxide. Solid or particulate carbonaceous material entrained in a carrier gas is also delivered to the metal pool in order to recarburize the hot melt. The carbon monoxide combustion and oxidation of the carbonaceous material creates a release of energy which is ultimately and efficiently used to melt large quantities of scrap added to the pool.

It is well known to those skilled in the art that the simultaneous delivery of almost pure oxygen and a carbonaceous material through the same delivery device in an environment where the temperatures exceed 1400° C. is extremely difficult and harzardous and requires precautionary measures. For example, extreme care must be taken in order to avoid leaks between different delivery tubes which might lead to explosive contact between the oxygen and carbon materials. In that connection, it must be borne in mind that the entrained carbonaceous particulate material is highly abrasive, and could wear through a spacer or divider wall.

Other difficulties and precautions become apparent when a cooling system is utilized. While it is advantageous to incorporate a cooling system into the delivery device, the cooling circuit must be minimized with respect to space and quantity of cooling fluid to be used. The minimization of these two factors is crucial because, in the event of a leak or break in the cooling system, the amounts of fluid reaching the metal pool must be limited so as to avoid contamination of the melt and damage to the refining process.

Finally, although the tasks to be performed by the delivery device are extremely complex, the device should preferably have a relatively simple construction which should be inexpensive to manufacture.

SUMMARY OF THE INVENTION

The above discussed and other problems of the prior art are overcome or alleviated by the oxygen and carbon delivery device of the present invention. In accordance with the present invention, a delivery device, commonly known as a blowing lance, is presented with a head portion comprised of a monolithic block having a series of nozzles incorporated therein and a block housing having a series of orifices or openings which correspond to each of the block nozzles. The block housing acts as an outer sheath to the interior block and is connected thereto by a plurality of connectors. The outer block housing or sheath cooperates with the interior block such that a passage capable of circulating a cooling fluid is defined therebetween. The block and block sheath of the blowing lance of the present invention have a centrally located longitudinal cavity, the diameter of which is larger in the block than in the block sheath. This passage receives a central tube placed therein whereby either gas alone or a gas entrained with solid matter may be transported therethrough. The central tube is surrounded by a duct which will communicates with the passage between the block and block housing for flow of a screening and cooling fluid. The particular configuration hereinabove discussed provides a blowing lance head capable of simultaneously delivering a material which may be incompatible with other materials whereby the incompatible materials are protected from one another by a screen comprised of a fluid which also acts as a coolant. In a preferred embodiment, the upper portion of the block has a plurality of circular connectors which are concentric with respect to the vertical axis of the lance head. These connectors are positioned so as to form the boundary walls for circular chambers wherein the previously discussed nozzles terminate. These concentric circular passages are fitted with concentric tubing to provide independent flow passages.

The novel blowing lance of the present invention has the important capability of simultaneously transporting and delivering incompatible materials (i.e., oxygen and carbon) with the avoidance of contact therebetween. As an added desirable feature, the protective structure which avoids the physical contact between the incompatible materials also functions as a cooling agent.

Another advantage of the present invention is the simplicity and ease of construction when manufacturing the blowing lance. This simplicity stems from the fact that the lance head essentially consists of an innder block and an outer block housing, both of which may cast or molded and a variety of standard tubings, all of which are easily and readily obtainalbe. Of course, this ease of manufacture permits lower parts and labor cost and therefore a relatively inexpensive finished product.

The above discussed and other advantages of the present invention will be apparent to and understood by those skilled in the art from the following detailed description and drawings.

BRIEF DESCRIPTION OF THE DRAWINGS

Referring now to the drawings wherein like elements are numbered alike in the several FIGURES:

FIG. 1 is a cross-sectional elevation view of the monolithic block of the head portion of the blowing lance in accordance with the present invention.

FIG. 2 is a cross-sectional elevation view of the block housing which envelopes the block of FIG. 1.

DESCRIPTION OF THE PREFERRED EMBODIMENT

Figure 3:
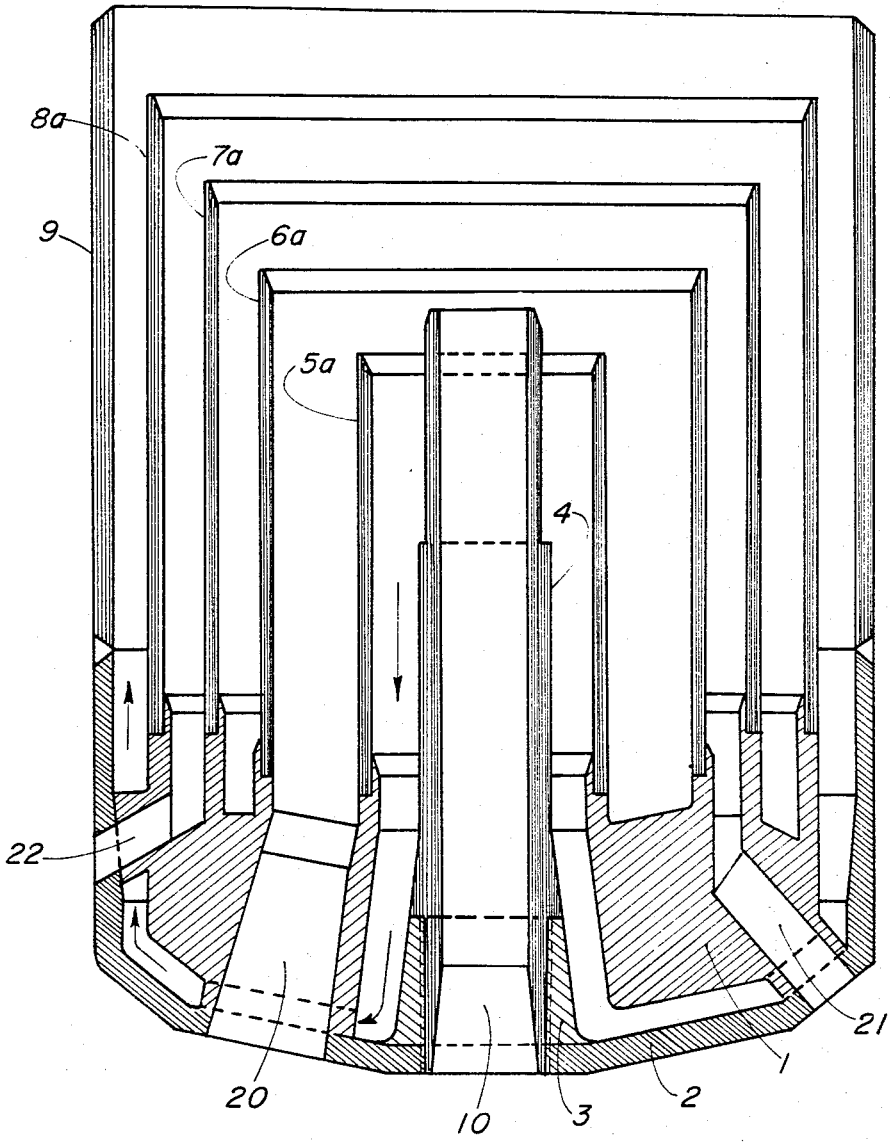
FIG. 3 is a cross-sectional view of the block and block housing of FIGS. 1 and 2 respectively shown is an assembled configuration in accordance with the present invention.

Referring first to FIG. 3, the monolithic block 1 has a centrally located longitudinal cavity 10 which runs in the direction of the vertical axis of the lance head. The walls of cavity 10 will form the passage for transporting entrained solid materials as well as providing ducting through which flows cooling and protective liquid.

Nozzles 20, 21 and 22 used for blowing or delivering oxygen are shown in FIGS. 1 and 3. Note that nozzle 20 is only slightly inclined with respect to the vertical axis so that oxygen can be delivered therethrough for penetration beneath the surface of the hot melt during the refining process, while the nozzles 21 and 22 are inclined at a greater angle so that post combustion oxygen utilized to oxidize the carbon monoxide can be delivered above the surface of the metal pool.

FIG. 1 also shows that the block 1 has on its upper face concentric circular connectors 5, 6, 7 and 8 which form the boundary walls for the concentric circular chambers. Thus, connector 5 forms the central cavity 10 while connectors 5 and 6 form a chamber therebetween which communicates with nozzle 20. Similarly, connectors 6 and 7 form the boundary walls for a chamber which communicates with nozzle 21 and finally, connectors 7 and 8 bound a chamber communicating with nozzle 22. Nozzles 20, 21 and 22 are merely representative of a possible configuration to be employed in the present invention. It should be understood that any number and kind of nozzles may extend from the various chambers depending on the needs and specifications of the refining process. For example, one preferred configuration which has been found useful includes three nozzles 20, three nozzles 21 and six nozzles 22. The lower portion of block 1 also has extension members 20(*b*), 21(*b*) and 22(*b*) which act to extend nozzles 20, 21 and 22 respectively and also to space the block 1 from the block housing 2 after insertion therein as shown in FIG. 3.

Referring now to FIG. 2, a block sheath or housing 2 is shown, which is equipped with a central collar 3. This collar 3 is intended to serve as support for the central passage 10 which will transport the solid carbonaceous material. Collar 3 may be connected to the block housing 2 or be an integral part thereof. The block housing 2 has orifices or openings 10(*c*), 20(*c*), 21(*c*) and 22(*c*) which correspond to nozzles 10, 20, 21, and 22 of the block 1. These orifices or openings will communicate with corresponding extention members 20(*b*), 21(*b*) and 22(*b*) after assembly of the block 1 and housing 2. Note that openings 10(*c*), 20(*c*), 21(*c*) and 22(*c*) may be made after the assembly is complete. The assembly of the head portion of the present invention is accomplished by the insertion of the outer surface of the block 1 into the interior surface of block housing 2. After insertion therein of block 1 into block sheath 2, extension members 20(*b*), 21(*b*) and 22(*b*) will act to space block 1 from housing 2 and provide a passage for a cooling and protective liquid to flow therethrough. The block 1 and housing 2 may be secured to each other by any suitable fastening or securing means.

An important advantage of the present invention can clearly be seen in FIG. 3 wherein is shown the assembly of the head portion of the blowing lance. The longitudinal central tube 10 connected to the collar 3 of the housing 2 is suitable for the transportation or delivery of carbonaceous material suspended in an appropriate transporting gas. The plurality of previously discussed connectors 5, 6, 7, and 8 are linked to the upper surface of the block 1 and are connected to concentric tubes 5(*a*), 6(*a*), 7(*a*) and 8(*a*). In accordance with the present invention, the passage between the tube 5(*a*) and the connector 5 and the tube 4 can be used as a concentric flow or entry duct for a cooling and protective fluid to flow therethrough. The passages between the tubes 5(*a*) and 6(*a*), 6(*a*) and 7(*a*) and 7(*a*) and 8(*a*) lead to tuyeres 20, 21, and 22 respectively. Thus, as a result of the particular configuration of the cooling fluid passages as shown in FIG. 3, a protective screen is established between the tube 4 and the other ducts thereby permitting the simultaneous transportation of mutually incompatible materials within the same blowing lance. Thus, even if tube 4 or connector 5 is breached, the carbon material will not contact the oxygen flowing to nozzles 20 or 22. In FIG. 3 the flow of the cooling and protective fluid is indicated by the arrows which show the cooling fluid flows through the duct between the tubes 4 and 5(*a*) and through the passage defined by the spacing between block 1 and housing 2. Although flow arrows are shown only on one side in FIG. 3, it will be understood that both the flow path and flow are concentric or symmetrical about the central axis of the lance. Thus, the fluid travels through the blowing lance of the present invention in such a manner as to contact a maximum amount of external surface area of the head portion of the lance. It should be understood that the only places which are not cooled are the openings of the nozzles 10, 20, 21 and 22.

The blowing lance of the present invention can be manufactured with relative ease and at low cost. This is due in part to the simplicity in design and construction of the novel head portion of the lance. Thus, the block 1 and housing 2 lend themselves to manufacture by simple mold casting, and the various openings are easily obtainable by drilling methods. The formation of the various connectors and the nozzles may be allowed for in the lay out of the mold. With respect to the upper concentric connectors and passageways, they may be easily obtained by conventional turning and milling methods. The block 1 is preferably constructed of copper as is the block housing or sheath 2. It should be understood that the block 1 and the block housing 2 may also be formed as a unitary monolithic assembly which may be relatively easy to manufacture through mold casting. Conversely, the block 1 and block housing 2 may be manufactured as separate pieces as shown in the figures. In this way the block 1 may be easily salvaged in the event that the block housing 2 is damaged.

The tube 4 may be connected to the collar 3 by screws or any other conventional connecting method. Also, if desired, a toric joint between the top of the collar 3 and the adjacent portion of the tube 4 may be utilized.

According to a recommended or preferred embodiment of the present invention, the blowing lance will have a certain previously determined number of nozzles with diameters corresponding to the angles of tilt with respect to the vertical. This particular preferred configuration is as follows:

TABLE I

| NUMBER OF TUYERES | TYPE OF TUYERE | DIAMETER AND ANGLE OF TILT | MATERIAL BLOWN |
|---|---|---|---|
| 1 | Nozzle 10 | 40–45 mm @10° | Strong jets of oxygen |
| 2 | Nozzle 20 | 40–45 mm @10–15° | Strong jets of oxygen |
| 3 | Nozzle 21 | 25 mm @30–45° | Soft jets of oxygen |
| 4 | Nozzle 22 | 20 mm @60–90° | Soft jets of oxygen |

It is possible that other tilt angles greater than 90°, for example 120°, may be desired depending upon the particular circumstances.

In accordance with the present invention, the channel of protective and cooling fluid travelling through the device will be a closed circuit. This circuit will include between the entry into the blowing lance and the exit thereof at the exterior of the lance a pump, a heat exchanger, and a sealed reservoir (all of which are not shown), as well as devices to continuously measure the pressure of the fluid at the entry and exit points in the lance as the fluid is transported through the channel. These measurement instruments or devices should be connected to a suitable alarm system so that in the event of a loss in pressure or any pressure differential between the entry and exit points, appropriate action may be taken to alleviate the problem.

Thus, the novel blowing lance of the present invention can simultaneously and safely transport and deliver incompatible materials (i.e., oxygen and carbon) with a reduced fear of explosive contact therebetween. Furthermore, the protective structure which avoids the physical contact between the incompatible materials will also function as a needed cooling agent.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A blowing apparatus for simultaneously delivering gaseous and solid materials to a hot melt, the apparatus comprising:

a block, said block having an axis;

a plurality of annular elements in said block concentric with respect to said axis of said block, said annular elements forming the boundary walls for a plurality of corresponding concentric chambers therebetween;

at least one of said chambers forming a central longitudinal passage;

at least one nozzle in said block communicating with at least one other of said chambers;

a block sheath cooperating with and separable from said block, said block sheath including a substantially cylindrical side wall portion and forming a housing for said block;

a central opening in said block sheath communicating with said central longitudinal passage;

means for spacing said block and said block sheath;

at least one opening in said block sheath corresponding to each of said nozzles, each said nozzle communicating with its corresponding opening in said block sheath;

said spacing means acting to space said block from said block sheath, thereby forming body passage means for fluid to flow therethrough between said block and said block sheath;

a plurality of concentric tubes, each of said tubes corresponding to and being connected with one of said annular elements, at least one pair of adjacent concentric tubes cooperating to define a gas supply passage in flow communication with said one nozzle; and a central longitudinal tube connected to said central opening in said block for the delivery of solid material therethrough, said central tube being within said plurality of concentric tubes, and said central tube and the innermost of said concentric tubes cooperating to define a fluid flow passage connected to and communicating with said body passage means.

2. The apparatus of claim 1 wherein:

said one nozzle is inclined at an angle with respect to said axis.

3. The apparatus of claim 1 including:

a plurality of said nozzles, each of said nozzles having an extension projecting beyond said block, said extensions serving as said spacer means, said extensions contacting said block sheath to space said block sheath from said block to define said body passage means.

4. The apparatus of claim 3 including:

at least one nozzle inclined at a first angle with respect to said axis; and at least a second nozzle inclined at a second angle with respect to said axis.

5. Blowing apparatus for delivering gaseous and solid material to a metal bath in a vessel, the apparatus including:

monolithic block means having a first passage means for delivery of solid material to the metal bath;

second passage means in said block means defining nozzle means for delivery of gaseous material to the metal bath;

housing means around said block means, said housing means including a substantially cylindrical sidewall portion, said housing means being separable from said block means, said housing means having first orifice means corresponding to and communicating with said first passage means and second orifice means corresponding to and communicating with said nozzle means;

spacer means spacing said housing means from said block means to define fluid passage means for the flow of fluid about said block means; and a plurality of concentric tube means, a first of said tube means being in said first passage means, a second of said tube means cooperating with said first tube means to define a flow passage connected to said cooling passage means, and a third of said tube means cooperating with said second tube means to define a gas supply passage to said nozzle means.

6. Blowing apparatus as in claim 5 including:

a plurality of nozzle means in said block; and a plurality of pairs of concentric tubes cooperating to define gas supply passages to each of said nozzle means.

7. Blowing apparatus as in claim 6 wherein said block includes:

a plurality of concentric connector elements defining annular passages between adjacent pairs of connector elements;

each of said nozzle means being connected to an associated annular passage; and each of said concentric tube means being connected to an associated connector element.

8. The blowing apparatus of claim 7 wherein:

said spacer means includes an extension from each of said nozzle means.

9. The blowing apparatus of claim 7 wherein:

the blowing apparatus has a central axis and said first tube means is centrally located on said axis and with respect to the remainder of said tube means and said first passage means is along said axis.

10. The apparatus of claim 7 wherein:

at least some of said nozzles are inclined with respect to said first passage means.

11. The apparatus of claim 9 wherein:

at least a first of said nozzles is inclined at a first angle to said axis, and at least a second of said nozzles is inclined at a second angle to said axis.

12. The apparatus of claim 3 wherein:

at least one of said nozzles contacts said block sheath at said cylindrical sidewall portion thereof.

13. The apparatus of claim 6 wherein:

at least one of said nozzles contacts said housing means at said cylindrical sidewall portion thereof.

14. The apparatus of claim 1 wherein:

said fluid is a cooling and protective fluid wherein the simultaneous transportation of mutually compatible material is permitted.

15. The apparatus of claim 5 wherein:

said fluid is a cooling and protective fluid wherein the simultaneous transportation of mutually compatible material is permitted.

* * * * *